US011079782B2

(12) United States Patent
Merkin et al.

(10) Patent No.: US 11,079,782 B2
(45) **Date of Patent: *Aug. 3, 2021**

(54) LOW POWER IDEAL DIODE CONTROL CIRCUIT

(71) Applicant: Texas Instruments Incorporated, Dallas, TX (US)

(72) Inventors: Timothy Bryan Merkin, Richardson, TX (US); Hassan Pooya Forghani-Zadeh, Fort Worth, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/678,733

(22) Filed: Nov. 8, 2019

(65) Prior Publication Data

US 2020/0073426 A1 Mar. 5, 2020

Related U.S. Application Data

(63) Continuation of application No. 15/638,892, filed on Jun. 30, 2017, now Pat. No. 10,503,186, which is a (Continued)

(51) Int. Cl.
*G05F 1/575* (2006.01)

(52) U.S. Cl.
CPC ..... *G05F 1/575* (2013.01)

(58) Field of Classification Search
CPC ..... G05F 1/575; G05F 5/565; G05F 1/569; G05F 1/571
See application file for complete search history.

(56) References Cited

U.S. PATENT DOCUMENTS 4,417,164 A 11/1983 Edlund
4,859,872 A 8/1989 Hyakutake
(Continued)

FOREIGN PATENT DOCUMENTS

CN 1297613 A 5/2001
CN 1420622 A 5/2003
(Continued)

OTHER PUBLICATIONS

Search Report for European Patent Application No. 15874378.1, dated Mar. 4, 2018, 8 pages.
(Continued)

*Primary Examiner* — Thienvu V Tran
*Assistant Examiner* — Bart Iliya
(74) *Attorney, Agent, or Firm* — Michael A. Davis. , Jr.; Charles A. Brill; Frank D. Cimino

(57) ABSTRACT

In described examples of a circuit that operates as a low-power ideal diode, and an IC chip that contains the ideal diode circuit, the circuit includes: a first P-channel transistor connected to receive an input voltage on a first terminal and to provide an output voltage on a second terminal; a first amplifier connected to receive the input voltage and the output voltage and to provide a first signal that dynamically biases a gate of the first P-channel transistor as a function of the voltage across the first P-channel transistor; and a second amplifier connected to receive the input voltage and the output voltage and to provide a second signal that acts to turn off the gate of the first P-channel transistor responsive to the input voltage being less than the output voltage.

20 Claims, 4 Drawing Sheets

Related U.S. Application Data continuation of application No. 14/978,532, filed on Dec. 22, 2015, now Pat. No. 9,696,738.

(60) Provisional application No. 62/096,673, filed on Dec. 24, 2014, provisional application No. 62/195,113, filed on Jul. 21, 2015.

(56) References Cited

U.S. PATENT DOCUMENTS

| | | | | |
|---|---|---|---|---|
| 5,469,564 | A | 11/1995 | Junya | |
| 7,772,816 | B2 * | 8/2010 | Cho | G05F 1/56 323/280 |
| 9,041,369 | B2 * | 5/2015 | Richter | G05F 1/565 323/281 |
| 9,696,738 | B2 | 7/2017 | Merkin et al. | |
| 2003/0107048 | A1 | 6/2003 | Nakashimo | |
| 2008/0088285 | A1 * | 4/2008 | Zhou | G05F 1/56 323/271 |
| 2009/0256540 | A1 | 10/2009 | Yang et al. | |
| 2009/0256616 | A1 | 10/2009 | Garrett | |
| 2010/0207921 | A1 | 8/2010 | Song et al. | |
| 2011/0089989 | A1 | 4/2011 | Furumiya et al. | |
| 2013/0069613 | A1 | 3/2013 | Nakase et al. | |
| 2014/0333281 | A1 | 11/2014 | Li | |
| 2015/0177759 | A1 | 6/2015 | Mallinson | |
| 2016/0079805 | A1 | 3/2016 | Reynolds | |
| 2016/0139640 | A1 | 5/2016 | Hijazi et al. | |

FOREIGN PATENT DOCUMENTS

| | | | |
|---|---|---|---|
| CN | 102386911 | A | 3/2012 |
| EP | 2747284 | A1 | 6/2014 |
| WO | 9953618 | A1 | 10/1999 |

OTHER PUBLICATIONS

Office Action for Chinese Patent Application No. 201580070605.0, dated Nov. 15, 2018, 9 pages.

* cited by examiner

LOW POWER IDEAL DIODE CONTROL CIRCUIT

CROSS-REFERENCE TO RELATED APPLICATIONS

Under 35 U.S.C. § 120, this continuation application claims benefits of priority to U.S. patent application Ser. No. 15/638,892 (TI-75724A), filed on Jun. 30, 2017, which claims the benefits of priority to U.S. patent application Ser. No. 14/978,532 filed Dec. 22, 2015, which claims priority to U.S. Provisional Patent Application Ser. No. 62/096,673 filed Dec. 24, 2014 and to U.S. Provisional Patent Application Ser. No. 62/195,113 filed Jul. 21, 2015, all of which are hereby fully incorporated herein by reference for all purposes.

BACKGROUND

This relates generally to circuit design, and more particularly to a circuit, chip and method that controls a transistor to provide functionality of an ideal diode having both fast forward recovery and fast reverse recovery.

In low power applications that require a diode, the forward voltage drop of the diode can create either supply headroom issues or excessive power dissipation. A Schottky diode can reduce this voltage drop, but Schottky diodes aren't available in most semiconductor processes. To avoid these issues, a single transistor can be used in place of the diode, with the gate voltage of the transistor controlled to act as an ideal diode. There is a need for an "ideal diode" circuit that has a fast forward drop recovery and a fast reverse recovery with low voltage headroom for very low power applications.

SUMMARY

In described examples of a circuit that operates as a low-power ideal diode, the circuit includes: a first P-channel transistor connected to receive an input voltage on a first terminal and to provide an output voltage on a second terminal; a first amplifier connected to receive the input voltage at a first input and the output voltage at a second input and to provide a first signal that dynamically biases a gate of the first P-channel transistor as a function of the voltage across the first P-channel transistor; and a second amplifier connected to receive the input voltage at a first input and the output voltage at a second input and to provide a second signal that acts to turn off the gate of the first P-channel transistor responsive to the input voltage being less than the output voltage.

In further described examples, a power management chip includes a first connection for a first power supply having a first voltage; a second connection for a second power supply having a second voltage higher than the first voltage; and an internal power rail for the chip, wherein the first power supply and the second power supply are each connected to the internal power rail through a circuit comprising: a first P-channel transistor connected to receive an input voltage on a first terminal and to provide an output voltage on a second terminal; a first amplifier connected to receive the input voltage at a first input and the output voltage at a second input and to provide a first signal that dynamically biases a gate of the first P-channel transistor as a function of the voltage across the first P-channel transistor; and a second amplifier connected to receive the input voltage at a first input and the output voltage at a second input and to provide a second signal that acts to turn off the gate of the first P-channel transistor responsive to the input voltage being less than the output voltage.

DETAILED DESCRIPTION OF EXAMPLE EMBODIMENTS

Figure 1:
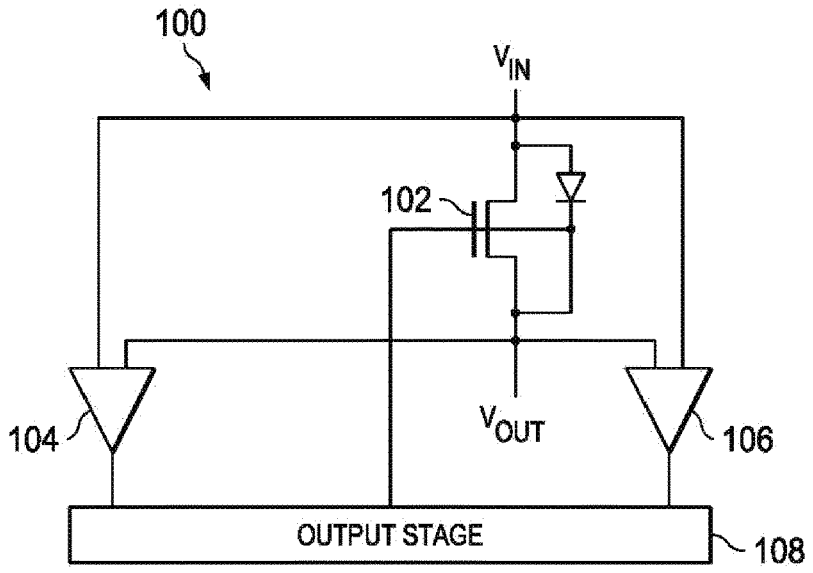
FIG. 1 illustrates an example of a circuit that operates as a low-power ideal diode according to an embodiment.

In the drawings, like references indicate similar elements. In this description, different references to "an" or "one" embodiment are not necessarily to the same embodiment, and such references may mean at least one. Further, when a particular feature, structure or characteristic is described in connection with an embodiment, such feature, structure or characteristic may be effected in connection with other embodiments, irrespective of whether explicitly described.

Described examples include an ideal diode circuit and a chip containing an ideal diode. The ideal diode circuit may include low power, low voltage operation, fast reverse recovery speed, and fast forward recovery speed.

A diode's primary purpose is to allow current in a single direction. Ideally, this means zero forward biased voltage drop, zero reverse current, and zero equivalent series resistance when forward biased. The closest approximation of these ideals can be achieved by using a single transistor as a switch and controlling the gate voltage as a function of the voltage across it. Several timing issues are also important in the optimal operation of an ideal diode. For example, if a diode is conducting in a forward condition and is immediately switched to a reverse condition, the diode will conduct in a reverse direction for a short time as the forward voltage bleeds off. The current through the diode will be fairly large in a reverse direction during this small recovery time, known as reverse recovery time. After the carriers have been flushed and the diode is acting as a normal blocking device in the reversed condition, the current flow should drop to leakage levels. Similarly, forward recovery time is the time required for the voltage to reach a specified value after a large change in forward biasing. It is desirable that both the reverse recovery time and the forward recovery time be minimized.

FIG. 1 shows a circuit 100 that operates as a low-power ideal diode according to an embodiment. Transistor 102 receives an input voltage VIN on a first terminal and provides an output voltage VOUT on a second terminal. The body of Transistor 102, as created, contains two parasitic diodes facing in opposite directions. However, in the embodiment shown, the gate of Transistor 102 has been connected to the body to short out one of the parasitic diodes, so only one diode is shown. Transistor 102 is the main pass transistor and its gate is controlled to perform as a diode. Amplifier 104 is connected to receive VIN and VOUT as inputs and to provide an output to Output Stage 108. Similarly, Amplifier 106 is also connected to receive VIN and VOUT as inputs and to provide an output to Output Stage 108. The output of Output Stage 108 is then connected to control the gate of Transistor 102. In at least one embodiment, Output Stage 108 is simply a node that combines the outputs of Amplifier 102 and Amplifier 104. In at least one embodiment, Output Stage 108 is a circuit that receives the outputs of Amplifier 102 and Amplifier 106 in a manner that smooths the operation of Transistor 102. To achieve the goal of an ideal amplifier, Amplifier 104 is configured to provide a shortened turn-off time for Transistor 102 whenever VOUT becomes greater than VIN and Amplifier 106 is configured to dynamically bias the gate of Transistor 102 as a function of the voltage across Transistor 102. Accordingly, if VOUT drops, e.g., due to a change in load, Amplifier 106 will adjust the gate of Transistor 106 to follow the changing needs.

Figure 2:
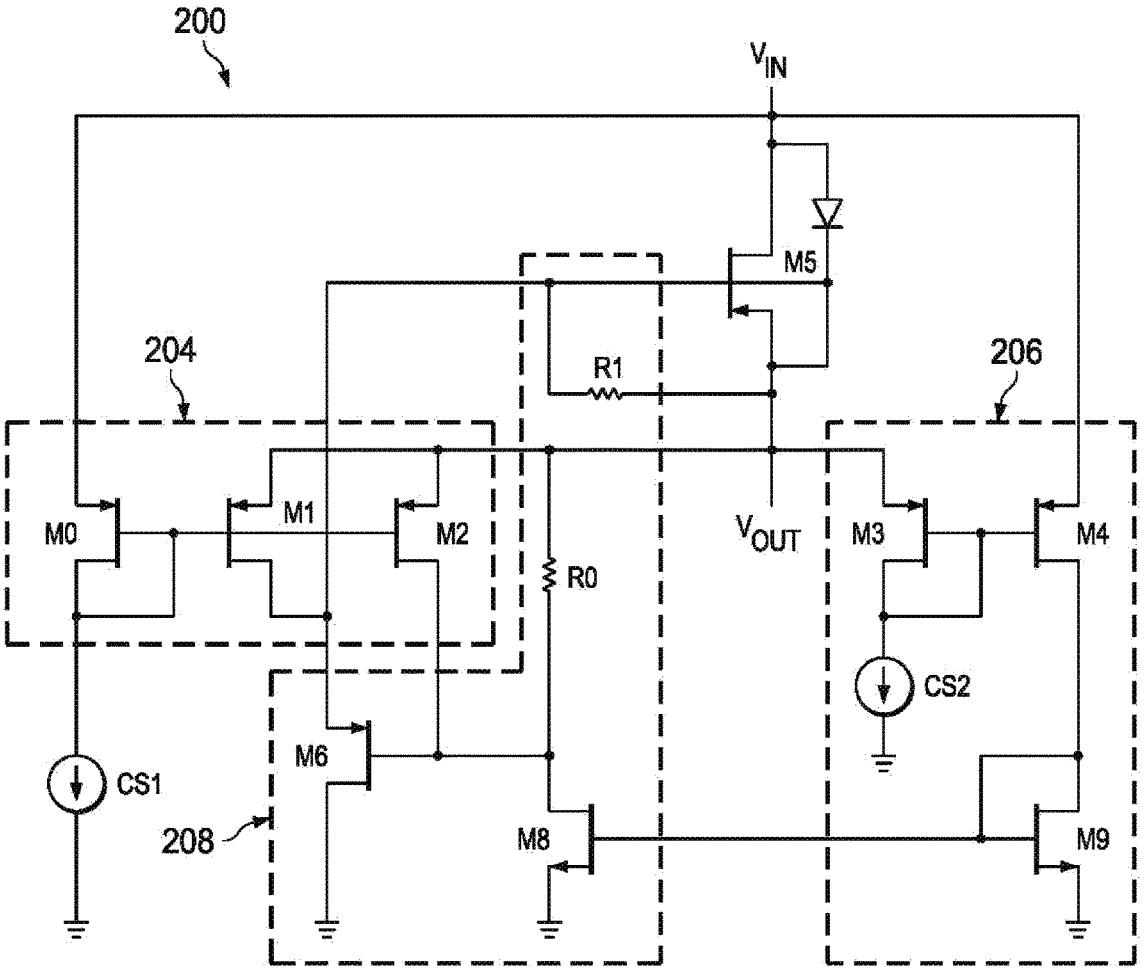
FIG. 2 illustrates a specific implementation of the circuit of FIG. 1 according to an embodiment.

Referring to FIG. 2, circuit 200 is a specific implementation of circuit 100. In at least one embodiment, which is described herein, circuit 200 is implemented in CMOS technology. However; the described circuit can also be realized in other technologies, e.g., bipolar junction transistors. Reference to CMOS technology or to component elements, such as N-Channel MOS (NMOS) and P-Channel MOS (PMOS) technology, is often a misnomer because the "metal" in CMOS circuits can be replaced with doped polysilicon, and the "oxide" can be replaced with other passivation layers. However, this terminology persists in spite of these changes. Accordingly, any reference herein to CMOS, NMOS and PMOS may also refer more generally to any related type of transistor technology, such as insulated-gate field-effect (IGFET) or metal-insulator-semiconductor FET (MISFET). In circuit 200, Transistor M5 is a PMOS transistor that is controlled to perform as a diode. Like Transistor 102, M5 receives VIN at a first terminal and provides VOUT at a second terminal. The source of M5 is shown in this figure as being connected to VOUT, and the drain to VIN. The transistor is shown this way to emphasize the fact that VOUT for this circuit can sometimes be greater than VIN, which is the reason that M5 is to act as a diode to prevent the backflow of current. The source and drain of M5 can be viewed as interchangeable, depending on whether VIN or VOUT is higher. The gate of M5 is connected to the source of M5 (as shown) through resistor R1 and is also connected to the source of PMOS Transistor M6, as further described hereinbelow. As in FIG. 1, the gate of M5 is connected to the body of M5 to short out one parasitic diode, so that only the parasitic diode shown is active. In at least one embodiment, the threshold voltage of the parasitic diode of M5 is about 0.7 volts. This threshold is too high to be useful in low-power situations, such as on portable devices, which typically operate on 3-5 volts. Thus, M5 is controlled to have a much lower threshold voltage, as described hereinbelow.

M0 is a diode-connected PMOS transistor having a source connected to VIN and a drain connected through current source CS1 to the lower rail, herein referred to as ground. The gate of M0 is tied to the gates of PMOS Transistors M1 and M2 to form a common-gate amplifier. M1 has a source connected to VOUT and a drain connected between the source of M6 and the gate of M5. M2 also has a source connected to VOUT; the drain of M2 is connected to the gate of M6. Transistor M6 has a source connected to M5, a drain connected to ground and a gate that receives input from M2, M8 and R0, where R0 is connected between VOUT and the drain of NMOS Transistor M8, while the source of M8 is connected to ground. Diode-connected PMOS Transistor M3 has a source connected to VOUT and a drain connected through current source CS2 to ground. PMOS Transistor M4 has a source connected to VIN and a drain connected to the drain of diode-connected NMOS Transistor M9. The source of M9 is connected to ground. The gates of M3 and M4 are connected together to form an Operational Transconductance Amplifier (OTA) and the gates of M8 and M9 are connected to mirror the current output from M4 and provide a voltage to M6.

In a described embodiment, M0, M1 and M2 together form Amplifier 204, which, like Amplifier 104 of FIG. 1, works to speed up the turn-off of transistor M5 when VOUT becomes greater than VIN. Likewise, M3, M4 and M9 form Amplifier 206, which like Amplifier 106, acts to dynamically bias the gate of M5 as a function of the voltage across M5. Transistors M6 and M8 together with Resistors R0 and R1 form Output Stage 208, which combines the outputs of Amplifiers 204, 206 to provide a smooth operation for M5. Another way to look at this example is to define M3, M4, M9, M8, R0 and M6 as part of a forward regulating loop while M0, M1 and M2 form a reverse blocking speed-up loop that aids in the shut-off speed of M5.

The operation of Circuit 200 is as follows. Looking first at Output Stage 208, the gate of M5 is controlled by M6, which can pull the gate of M5 towards ground when M6 is on, and also by M1, which can pull the gate of M5 upwards towards VOUT when M1 is on. The degree to which M6 is turned on is determined by three elements: R0 will always pull the gate of M6 towards VOUT; M8, when turned on, will pull the gate of M6 towards ground; and M2, when turned on, will assist in pulling the gate of M6 towards VOUT.

When VIN is greater than VOUT and current is flowing in a forward direction through M5, Amplifier 206 operates as follows to ensure quick forward recovery. M3 acts as a floating reference voltage for Amplifier 206 such that M4 essentially sees the voltage across M5. If VOUT goes low suddenly, the gate of M3 is pulled downward and will pull down on the gate of M4. M4 will then have a large gate/source voltage VGS, and will quickly allow increased current to M9, which also increases the voltage on the gate of M9. The gate of M9 will mirror the increased voltage on the gate of M8 so that M8 will turn on more fully. Turning on M8 will pull downward on the gate of M5, turning M6 on more strongly, which ultimately turns on M5 more strongly, providing the additional power needed. When VOUT becomes greater than VIN, the reverse will happen, with M4 being shut off, which in turn shuts off M9 and M8. With M8 turned off, R0 will eventually pull the gate of M6 to VOUT and turn off both M6 and M5, although by itself R0 acts more slowly than desired. This is the time when the action of Amplifier 204 becomes useful.

In Amplifier 204, M0 acts as a floating reference voltage so that M1 and M2 both see the voltage across M5. If VOUT is greater than VIN, the source of both M1 and M2 goes high, while their respective gates remain low because of the connection to the gate of M0. The low gate voltages and high source voltages turn both M1 and M2 on strongly, allowing more current to flow. M1 pulls the source of M6 towards VOUT and M2 helps to pull the gate of M6 towards VOUT, which acts to turn off M6 and M5. Because of the action of Amplifier 204, M5 is able to turn off much more quickly than would happen with only R0 pulling up on the gate.

In this embodiment, the forward regulating loop is controlled by the differential pair M3/M4 and the load is R0. This loop can be made output pole dominant with low impedance at the source of M6 and with R0 reducing effective impedance at the drain of M8, and a large decoupling capacitor on VOUT. One characteristic of the forward loop in this circuit is the fast forward recovery to heavy load steps. The reverse recovery speed-up loop in this circuit is not activated under normal forward bias conditions, but only when the voltage on VOUT increases above VIN. Note that there is no current flow from VOUT to ground when VOUT is greater than VIN.

Figure 3:
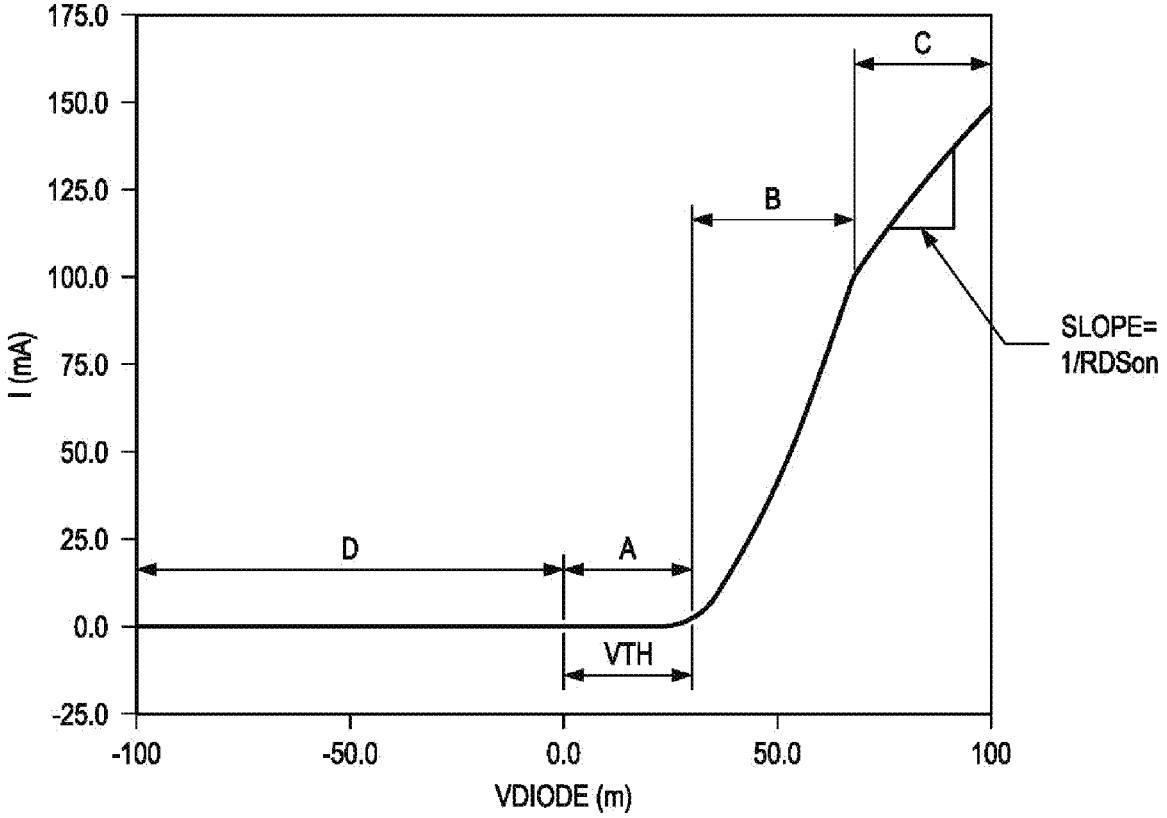
FIG. 3 depicts the diode characteristics of the circuit of FIG. 2 in terms of voltage and current.

FIG. 3 illustrates the DC current-voltage (I-V) curve characteristics of the embodiment of FIG. 2. In the embodiment illustrated, the current through M5 is zero for all negative voltages in region D of the curve, i.e., when VOUT is greater than VIN. As VIN becomes greater than VOUT, the current remains zero in region A until the threshold voltage, VTH is reached at about 30 millivolts. For comparison, the threshold voltage of a regular diode in this technology would be about 700 millivolts. Accordingly, the described circuit can be used in situations where voltage headroom is a concern or where power loss due to current flowing through a real diode is a concern. VTH is determined by the transconductance of differential pair M3, M4 times the resistance of R0. Above VTH, the current rises at a first rate in region B until the transistor is fully turned on. After the transistor is fully turned on, e.g., in region C, the slope of the I-V curve is a second value that is equal to the inverse of the drain/source resistance, i.e., 1/RDSon. The current to run the described circuit is taken from either the input current or the output current and can be very low power. In at least one implementation of the described control circuitry, the quiescent current supply (IDDQ) for the circuit is about 1.25 μA. Thus, in at least some implementations, the quiescent current supply is in the micro-amp range. The circuitry can be pushed even lower if needed, depending on design requirements, e.g., into the nano-amp range.

Figure 4:
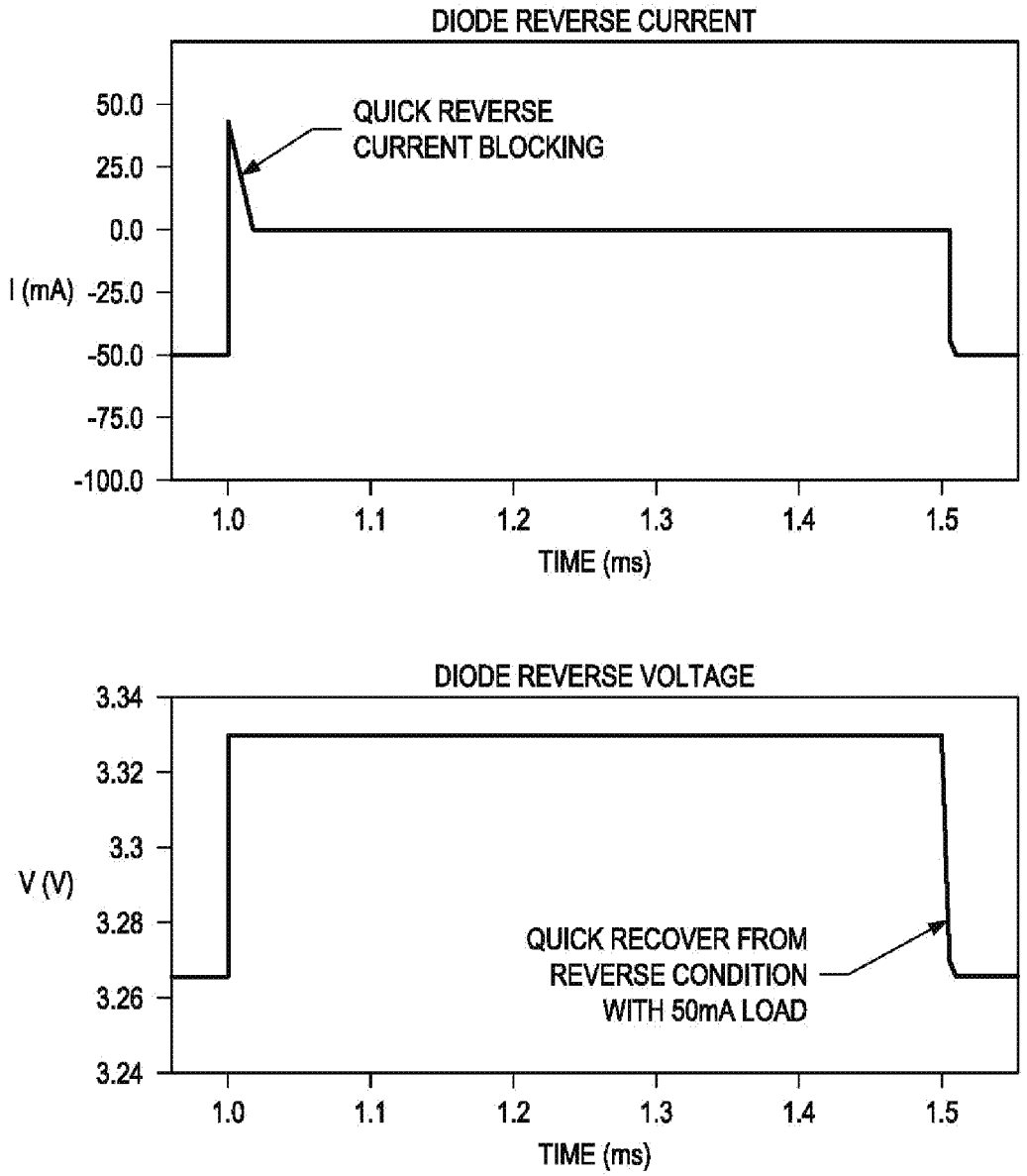
FIG. 4 depicts the transient diode characteristics of the circuit of FIG. 2.

FIG. 4 illustrates the transient characteristics of the ideal diode that is enabled by the described embodiments. As shown in the lower graph, the output voltage VOUT of the embodiment of FIG. 2 was switched from about 3.265 V to 3.33 V while the input voltage VIN was held at 3.3 V (not specifically shown). After 0.5 milliseconds, the output voltage was dropped back to its former level. The current response through ideal diode M5 is shown in the upper graph. As the reverse voltage was applied, a reverse current appeared, peaking at around 42 mA, but within 0.020 ms, the reverse current fell to zero. When the reverse voltage condition was removed, the current returned to previous levels. Note that no undershooting occurred in the voltage during recovery, even though this is a common problem in ideal diode circuits.

Figure 5:
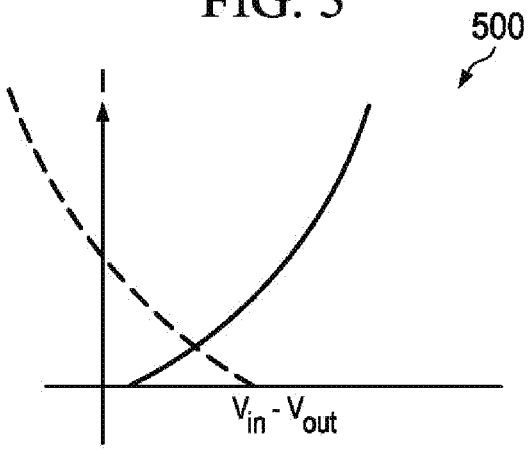
FIG. 5 depicts overlapping regions of operation of the circuit of FIG. 1.

FIG. 5 illustrates the region of operation 500 of both Amplifier 204 and Amplifier 206 according to one embodiment and plots the I-V graph for each of these amplifiers, where the voltage is measured as VIN-VOUT. This figure is not drawn to scale and is offered simply to illustrate that the operation of these two amplifier circuits will overlap. The dotted line represents the curve for Amplifier 204 and the solid line represents the curve for Amplifier 206. As can be seen in this figure, when the difference in voltages is in the negative region, i.e., VOUT is greater than VIN, only Amplifier 204 operates. As the voltage difference becomes more positive, the current from Amplifier 204 drops and the current from Amplifier 206 starts to grow, such that both amplifiers are acting at the same time. Finally, a point is reached where Amplifier 204 is completely turned off and only Amplifier 206 is active. This handoff between Amplifier 204 and Amplifier 206 provides a smooth operation of the circuit as a whole. The actual curve for each amplifier circuit is determined by the threshold voltages of the transistors in each circuit and the transconductance of the devices.

The control circuitry described hereinabove has many applications, including:

Zero reverse current switch;

Ideal diode OR-ing of multiple power sources with very little power loss (important in many low power battery operated devices); and Inside an Low Dropout (LDO) feedback loop to block any reverse current into the supply of the LDO.

Figure 6:
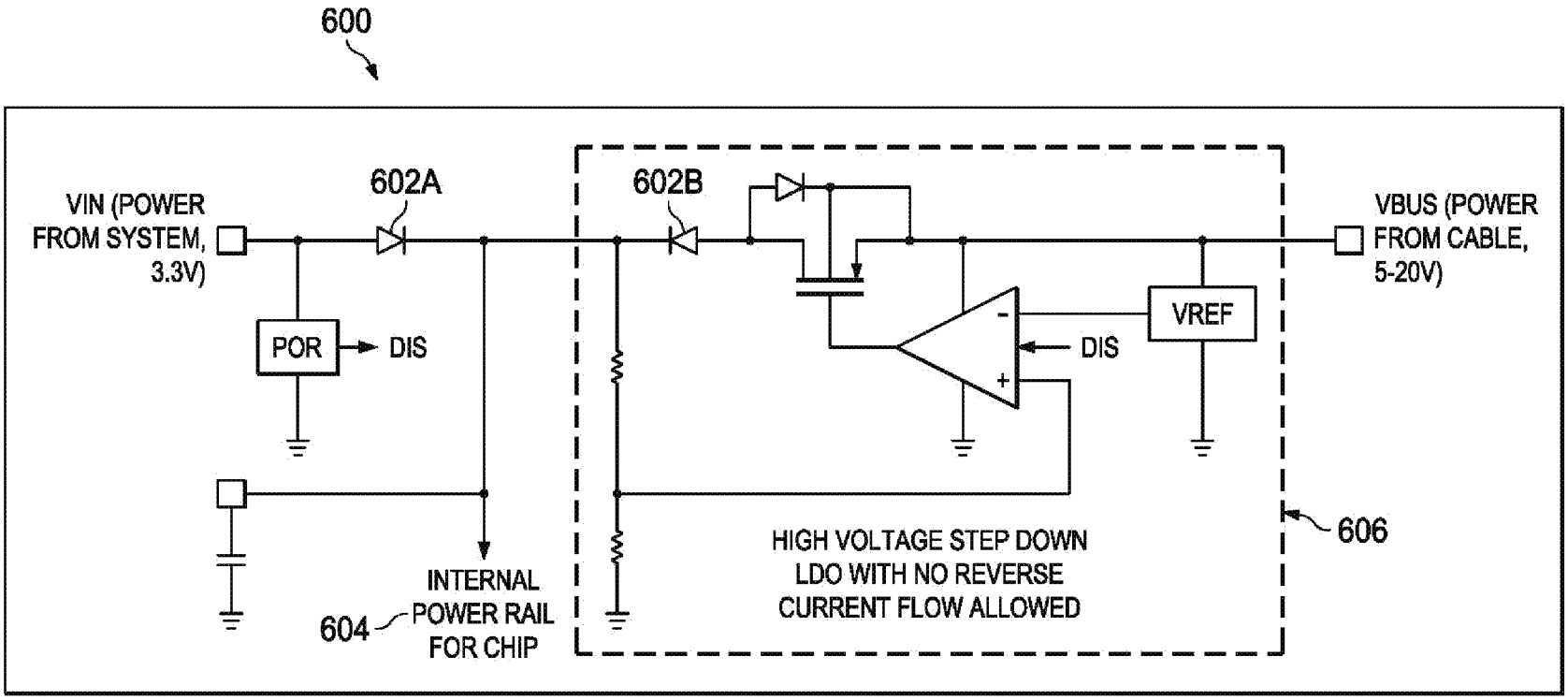
FIG. 6 depicts a chip that incorporates the circuit of FIG. 1 according to an embodiment.

FIG. 6 illustrates the use of the described ideal diode circuit in a larger circuit that has been realized in an Integrated Circuit (IC) Chip 600. The circuit shown in IC Chip 600 uses PMOS based ideal diodes 602A, 602B to create a single, diode-OR'ed internal power rail 604 from either VBUS, which connects to a cable (in the case of dead battery), or VIN, the system power supply at 3.3 V, with priority given to VIN. Notably, all low voltage elements can be used in ideal diode 602B as this diode appears on the low voltage side of LDO Regulator 606. FIG. 6 shows two diode-OR'ed inputs, but this is not a limitation, because this approach can be scaled to an unlimited number of input supplies.

In this description, reference to an element in the singular does not mean "one and only one" unless explicitly so stated, but rather "one or more." All structural and functional equivalents to the elements of the above-described embodiments that are known to those of ordinary skill in the art are expressly incorporated herein by reference.

Advantages of the described circuit may include one or more of the following: low power, low voltage operation, quick recovery in the forward direction, quick recovery the reverse direction, and small area. At least one embodiment of the described circuit is in a complementary metal-oxide semiconductor (CMOS) design.

Modifications are possible in the described embodiments, and other embodiments are possible, within the scope of the claims.

What is claimed is:

1. An apparatus comprising:

a pass transistor having a first current terminal coupled to a voltage input terminal, a second current terminal coupled to a voltage output terminal, and a gate terminal;

an amplifier having a first input coupled to the voltage input terminal, and a second input coupled to the voltage output terminal, the amplifier configured to generate a turn-off signal when the voltage output terminal has a greater voltage than the voltage input terminal; and an output stage having:

a p-channel field-effect transistor (PFET) having a source coupled to the gate of the pass transistor, a gate configured to receive the turn-off signal, and a drain coupled to a ground terminal;

an n-channel field-effect transistor (NFET) having a drain coupled to the gate of the PFET, a gate, and a source coupled to the ground terminal; and a resistor coupled between the voltage output terminal and the gate of the PFET.

2. The apparatus of claim 1, wherein the pass transistor includes a second PFET, and the gate of the pass transistor is coupled to a body of the pass transistor.

3. The apparatus of claim 1, wherein the output stage includes a second resistor coupled between the gate of the pass transistor and the voltage output terminal.

4. The apparatus of claim 1, wherein the amplifier includes:

a second PFET having a source coupled to the voltage input terminal, a gate, and a drain coupled to the gate of the second PFET; and a third PFET having a source coupled to the voltage output terminal, a gate coupled to the gate of the second PFET, and a drain coupled to the gate of the PFET.

5. The apparatus of claim 1, wherein the amplifier includes:

a second PFET having a source coupled to the voltage input terminal, a gate, and a drain coupled to the gate of the second PFET; and a third PFET having a source coupled to the voltage output terminal, a gate coupled to the gate of the second PFET, and a drain coupled to the source of the PFET.

6. The apparatus of claim 1, wherein the amplifier includes:

a second PFET having a source coupled to the voltage input terminal, a gate, and a drain coupled to the gate of the second PFET;

a third PFET having a source coupled to the voltage output terminal, a gate coupled to the gate of the second PFET, and a drain coupled to the gate of the PFET; and a fourth PFET having a source coupled to the voltage output terminal, a gate coupled to the gate of the third PFET, and a drain coupled to the source of the PFET.

7. The apparatus of claim 6, wherein the amplifier includes a current source coupled between the drain of the third PFET and the ground terminal.

8. The apparatus of claim 1, wherein the gate of the NFET is configured to receive a bias signal representing a voltage difference of the voltage input terminal above the voltage output terminal.

9. The apparatus of claim 1, further comprising:

a second amplifier having a first input coupled to the voltage input terminal, and a second input coupled to the voltage output terminal, the second amplifier configured to generate a bias signal based on a voltage difference of the voltage input terminal above the voltage output terminal.

10. The apparatus of claim 1, further comprising:

a second amplifier including:

a second PFET having a source coupled to the voltage output terminal, a gate, and a drain coupled to the gate of the second PFET;

a third PFET having a source coupled to the voltage input terminal, a gate coupled to the gate of the second PFET, and a drain; and a current mirror configured to mirror a first current from the drain of the third PFET to the drain of the NFET.

11. An apparatus comprising:

a pass transistor having a first current terminal coupled to a voltage input terminal, a second current terminal coupled to a voltage output terminal, and a gate terminal;

an amplifier having:

a first PFET having a source coupled to the voltage input terminal, a gate, and a drain coupled to the gate of the second PFET; and a second PFET having a source coupled to the voltage output terminal, a gate coupled to the gate of the first PFET, and a drain configured to deliver a turn-off signal; and an output stage configured to regulate the gate of the pass transistor based on a bias signal representing a voltage difference of the voltage input terminal and the voltage output terminal, and configured to turn off the gate of the pass transistor based on the turn-off signal.

12. The apparatus of claim 11, wherein the pass transistor includes a third PFET, and the gate of the pass transistor is coupled to a body of the pass transistor.

13. The apparatus of claim 11, wherein the output stage includes:

a third PFET having a source coupled to the gate of the pass transistor, a gate configured to receive the turn-off signal from the drain of the second PFET, and a drain coupled to a ground terminal;

an NFET having a drain coupled to the gate of the third PFET, a gate configured to receive the bias signal, and a source coupled to the ground terminal; and a resistor coupled between the voltage output terminal and the gate of the third PFET.

14. The apparatus of claim 13, wherein the output stage includes a second resistor coupled between the gate of the pass transistor and the voltage output terminal.

15. The apparatus of claim 13, wherein the amplifier includes a fourth PFET having a source coupled to the voltage output terminal, a gate coupled to the gate of the second PFET, and a drain coupled to the source of the third PFET.

16. The apparatus of claim 11, further comprising:

a second amplifier having a first input coupled to the voltage input terminal, and a second input coupled to the voltage output terminal, the second amplifier configured to generate the bias signal.

17. The apparatus of claim 11, further comprising:

a second amplifier including:

a third PFET having a source coupled to the voltage output terminal, a gate, and a drain coupled to the gate of the third PFET;

a fourth PFET having a source coupled to the voltage input terminal, a gate coupled to the gate of the third PFET, and a drain; and a second NFET having a drain coupled to the drain of the fourth PFET, a gate coupled to the drain of the second NFET and configured to deliver the bias signal, and a source coupled to a ground terminal.

18. An apparatus comprising:

a pass transistor having a first current terminal coupled to a voltage input terminal, a second current terminal coupled to a voltage output terminal, and a gate terminal;

an amplifier having:

a first PFET having a source coupled to the voltage input terminal, a gate, and a drain coupled to the gate of the second PFET; and a second PFET having a source coupled to the voltage output terminal, a gate coupled to the gate of the first PFET, and a drain; and an output stage configured to regulate the gate of the pass transistor based on a bias signal representing a voltage difference of the voltage input terminal and the voltage output terminal, the output stage including:

a third PFET having a source coupled to the gate of the pass transistor, a gate coupled to the drain of the second PFET, and a drain coupled to a ground terminal;

an NFET having a drain coupled to the gate of the third PFET, a gate, and a source coupled to the ground terminal; and a resistor having coupled between the voltage output terminal and the gate of the third PFET.

19. The apparatus of claim 18, wherein the output stage includes a second resistor coupled between the gate of the pass transistor and the voltage output terminal.

20. The apparatus of claim 18, wherein the amplifier includes a fourth PFET having a source coupled to the voltage output terminal, a gate coupled to the gate of the second PFET, and a drain coupled to the source of the third PFET.

* * * * *